US005424694A

United States Patent [19]

Maloratsky et al.

[11] Patent Number: 5,424,694

[45] Date of Patent: Jun. 13, 1995

[54] MINIATURE DIRECTIONAL COUPLER

[75] Inventors: Leo Maloratsky, Margate; John Ide, Boca Raton, both of Fla.

[73] Assignee: AlliedSignal Inc., Morris Township, Morris County, N.J.

[21] Appl. No.: 268,357

[22] Filed: Jun. 30, 1994

[51] Int. Cl.[6] ..... H01P 5/18

[52] U.S. Cl. ..... 333/112; 333/116

[58] Field of Search ..... 333/109, 112, 115, 116

[56] References Cited

U.S. PATENT DOCUMENTS 4,013,981 3/1977 Shintani et al. ..... 333/116 X 4,999,593 3/1991 Anderson ..... 333/112

*Primary Examiner*—Paul Gensler

*Attorney, Agent, or Firm*—Donald B. Paschburg

[57] ABSTRACT

A miniature directional coupler has short coupled lines, a series inductor and a parallel resistor connected to the second coupled line output. The coupled lines have a length considerably less than one quarter of a wavelength. Values of the series inductor and the parallel resistor are dependent on coupling, frequency, directivity, impedance and coupling flatness.

17 Claims, 3 Drawing Sheets

MINIATURE DIRECTIONAL COUPLER

BACKGROUND OF THE INVENTION

1. Field of the Invention

This invention relates to miniature receivers and transmitters operating in the HF, VHF, and UHF band and more particularly to microstrip directional couplers utilized in the receivers and transmitters. Description of the Prior Art U.S. Pat. No. 5,159,298 titled "Microstrip Directional Coupler with Single Element Compensation" describes a coupler which employs closed form solutions for the compensating capacitance or inductance and introduces a new odd mode characteristic impedance necessary to realize high directivity in microstrip directional couplers. The single capacitively-compensated microstrip directional coupler includes four ports and two symmetrical inner conductors separated by a gap on a dielectric substrate having a relative dielectric constant. At the far end of the coupled section, there is a lumped capacitor implemented on the microstrip. Therefore, capacitance or inductance connects two quarter wavelength coupled lines of a microstrip directional coupler to realize high directivity or match.

Prior art miniature devices have significant problems. These problems relate to decreasing dimensions (increasing of the integration level), the requirement to improve a coupling flatness and the tuning of the coupling and the center frequency. It is an object of the present invention to reduce overall size of the coupler, to improve coupling flatness in the equivalent bandwidth and to improve the tuning of the coupling and center frequency.

SUMMARY OF THE INVENTION

The invention herein presented is a miniature directional coupler comprised of a pair of coupled lines having geometric lengths considerably less than one quarter of a wavelength and separated by a gap. The second coupled line output is electrically connected with a series inductor and parallel resistor whose values are dependent on coupling, frequency, directivity, coupled line impedance, coupling flatness and length.

DETAILED DESCRIPTION OF THE INVENTION

Figure 1:
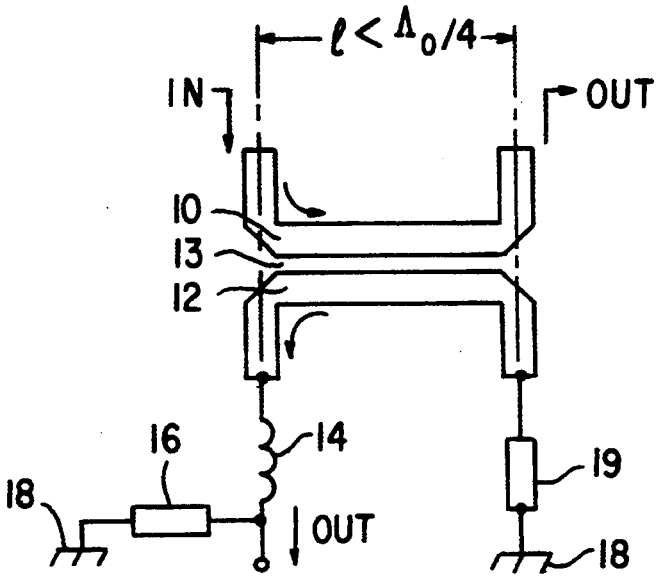
FIG. 1 illustrates a schematic of one embodiment of the present invention.

Referring to the drawings, FIG. 1 shows a microminiature directional coupler comprised of two coupled lines 10 and 12 which have a very short geometric length for HF, VHF and UHF range in comparison with $\Lambda_o/4$ (where $\Lambda_o$ is the center wavelength in coupled lines) separated by a gap 13. The coupled line length depends on electrical parameters: center frequency, insertion loss, coupling and directivity. In any case, the length of the coupled lines is much less than $\Lambda/4$ (length of the classic directional coupler). The second coupled line output is electrically connected with series inductor 14 and parallel resistor 16 tied to ground 18. The other end of the second coupled line is terminated with resistor 19 whose value is equal to the impedance of this second coupled line. Resistor 19 is tied to ground 18. The inductance value depends on the coupling flatness, center frequency, and coupling value, The parallel resistor value depends on the impedance of the second coupled line and inductance value.

Figure 3:
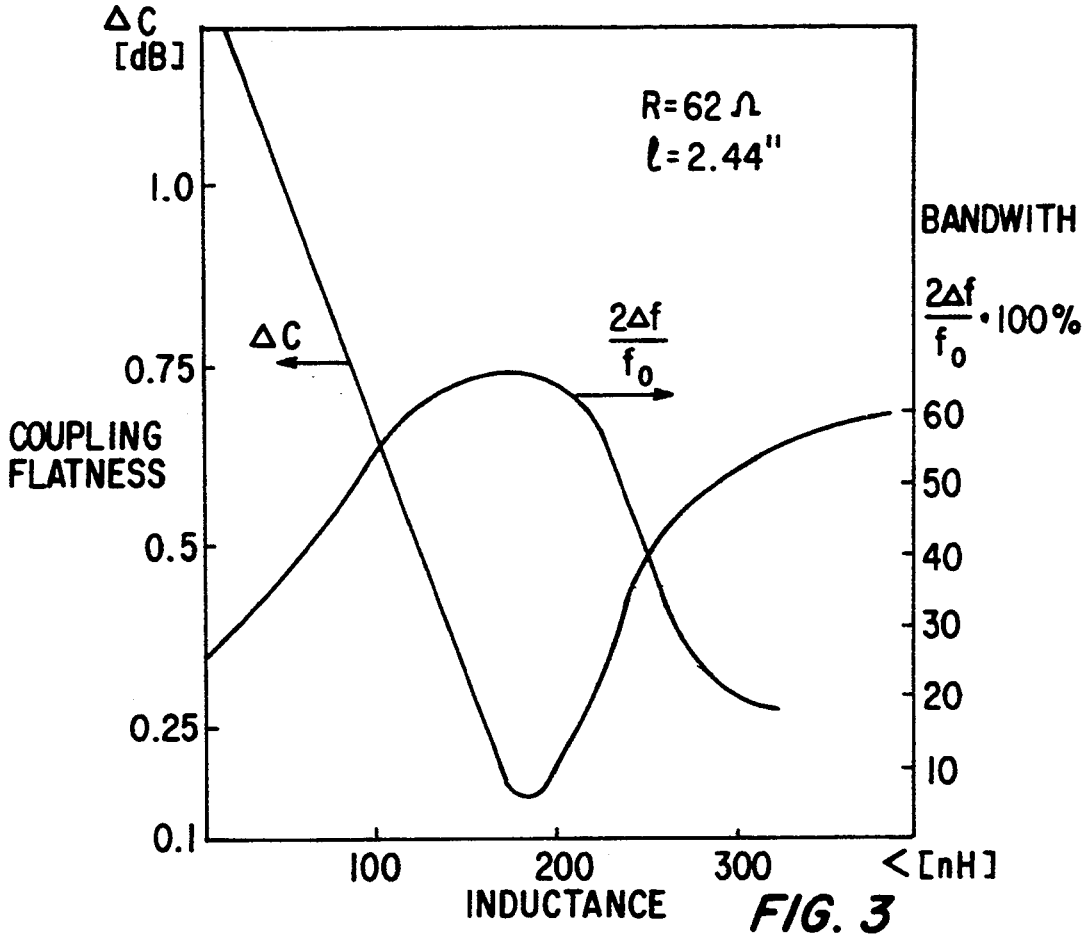
FIG. 3 is an experimental relation between inductance and coupling flatness for a certain frequency and bandwidth, and between inductance and bandwidth for one embodiment of the present invention.
Figure 4:
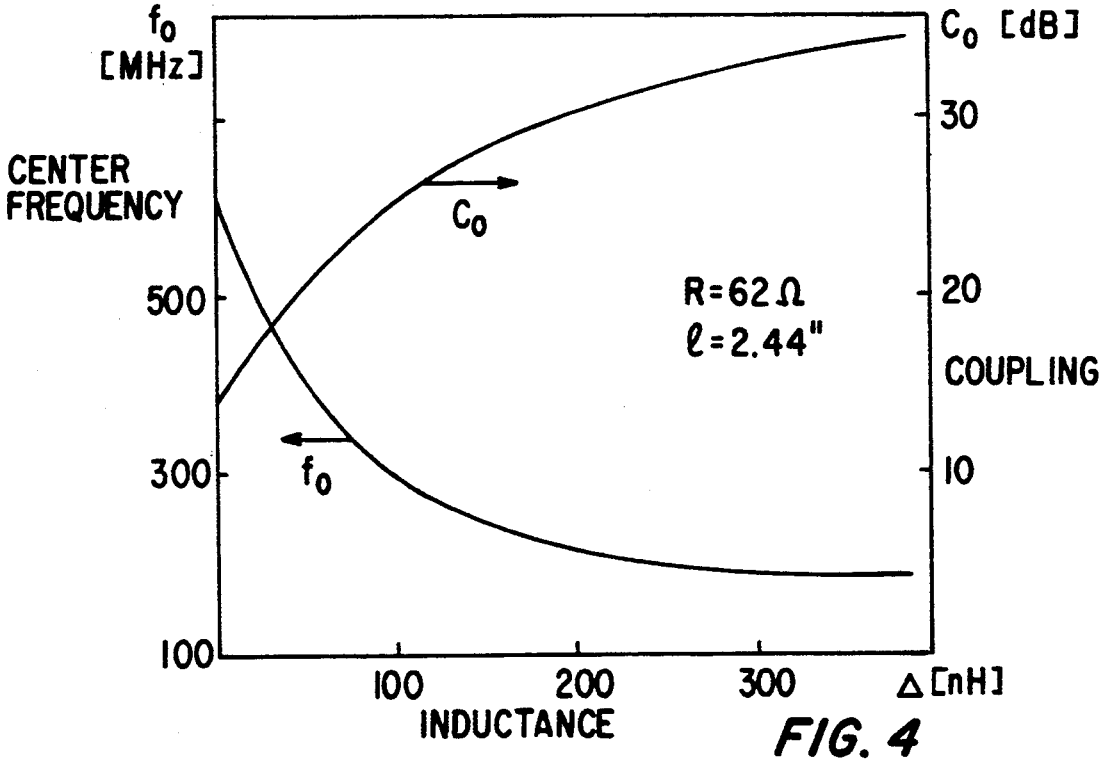
FIG. 4 is an experimental relation between inductance and coupling and center frequency.
Figure 5:
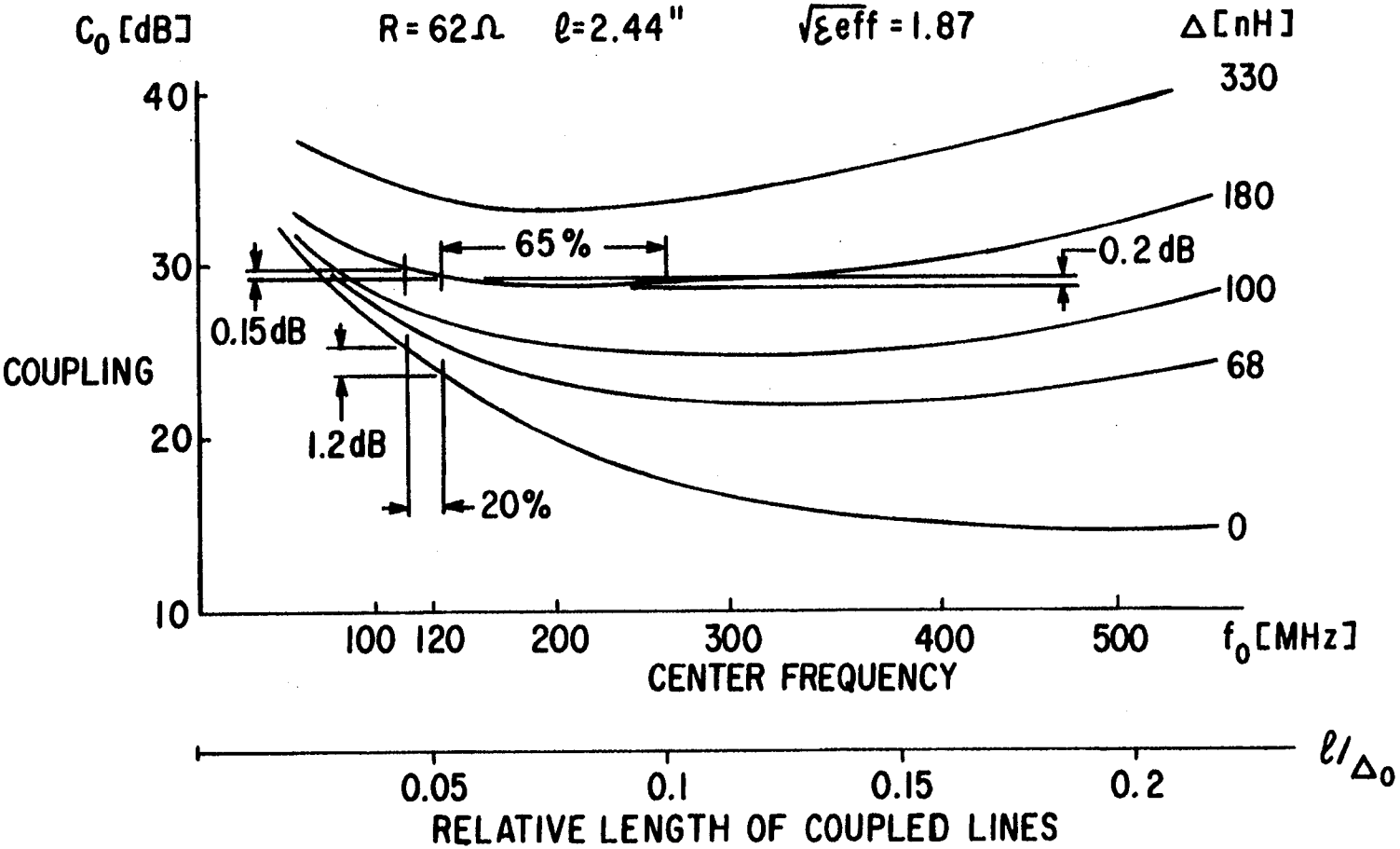
FIG. 5 is an experimental relation between coupling, center frequency or relative length of coupled lines and inductance for the same directional coupler.

FIG. 3 illustrates an experimental relation between inductance (in nH) and coupling flatness $\Delta C$ (in dB) for a frequency of 127 MHz. and a bandwidth of twenty percent and between inductance and bandwidth for a coupling flatness of 0.1 dB for a microstrip directional coupler having a coupled line length of 2.44 inches and a parallel resistor of 62 ohms. FIG. 5 illustrates an experimental relation between coupling (in dB), center frequency (in MHz.) or relative length of coupled lines ($l/\Lambda_o$) and inductance (in nH) for the same directional coupler. Experimentation shows in FIG. 3 and FIG. 5 that the present microstrip directional coupler having L=180 nH, R=62 Ohm for 20% bandwidth ($f_o$=120 MHz) has coupling flatness ±0.05 dB, directivity more than 23 dB, mainline loss less than 0.15 dB, VSWR is less than 1.1, and for 60% bandwidth ($f_o$=200 MHz) the coupling flatness is ±0.1 dB, directivity is greater than 20 dB, mainline loss is less than 0.25 dB, VSWR is less than 1.15, and length $l=0.05\ \Lambda_o$ (five times less than traditional directional couplers of $l=0.25\ \Lambda_o$). Tuning of the center frequency ($f_o$) and coupling ($C_o$) is realized by varying the inductor value as shown in FIG. 4 which illustrates an experimental relation between inductance L (in nH) and coupling $C_o$ (in dB) and center frequency $f_o$ (in MHz.).

Figure 2:
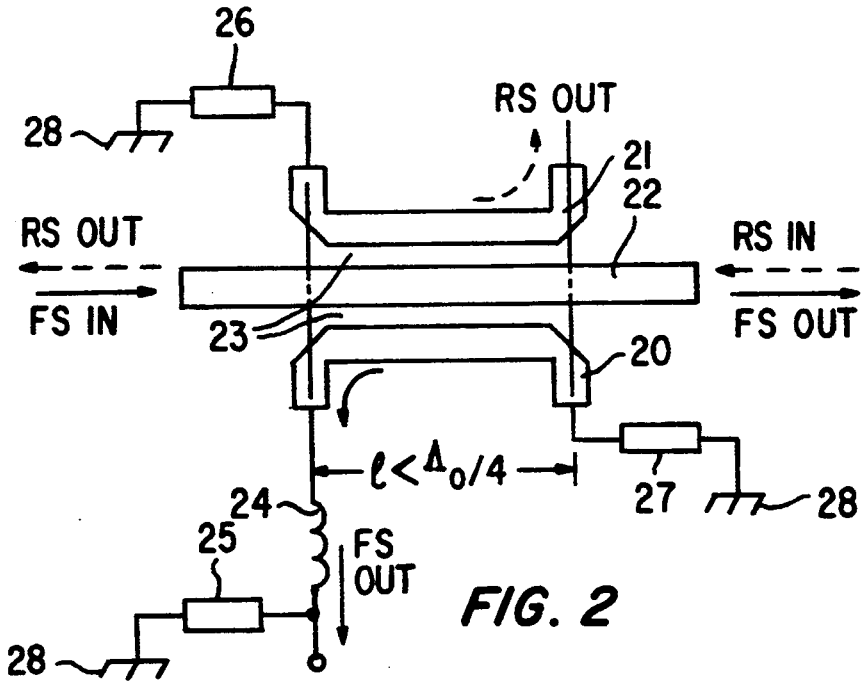
FIG. 2 illustrates a schematic of another embodiment of the present invention.

FIG. 2 illustrates another embodiment of the invention, a microminiature bi-directional coupler, having one minimum coupling flatness directional coupler comprised of two coupled lines 20 and 22 separated by a gap 23 with frequency correction for the forward signal (FS) and the second high directivity directional coupler comprised or two coupled lines 21 and 22 separated by a gap 23 for the reflection signal (RS). Resistors 26 and 27 lie between each coupled line and ground 28. Inductor 24 is connected between forward signal coupled line 20 and FS Out. Parallel resistor 25 is connected between FS out and ground 28.

The invention herein presented is a miniature directional coupler having geometric lengths of coupled lines considerably less than one quarter of a wavelength, having a series inductor and a parallel resistor connected to the second coupled line output and having a varying inductor value for tuning of the coupling and the center frequency. Compared with traditional $\Lambda_o/4$ directional couplers, the present invention provides for a miniature package in HF, VHF and UHF bands. The level of integration of the circuit is approximately five times higher than that of other well known devices. The coupling flatness in an equally wide band is four times better than the prior an because the series inductor with the parallel resistor compensates the changes of coupling with frequency changes. Tuning of the coupling and the center frequency is much improved because there is no need to change the configuration or size of the coupled lines. Tuning occurs by simply varying the inductor value.

It is not intended that this invention be limited to the hardware arrangement or operational procedures shown disclosed. For example, a configuration of the coupled lines can be realized by meander, saw-tooth, and other forms of lines. This invention includes all of the alterations and variations thereto as encompassed within the scope of the claims as follows.

We claim:

1. A miniature directional coupler comprising:

a first coupled line having an input and an output;

a second coupled line having an input and an output and separated from said first coupled line by a gap;

series resistor means connected between ground and said input of said second coupled line;

series inductor means connected between said output of said second coupled line and an output of said miniature directional coupler, and;

parallel resistor means connected between said series inductor means and ground.

2. A miniature directional coupler as claimed in claim 1 wherein said first coupled line and said second coupled line have a length of less than $\Lambda_o/4$ where $\Lambda_o$ is center wavelength in coupled lines.

3. A miniature directional coupler as claimed in claim 2 wherein said first coupled line and said second coupled line have a length dependent on center frequency, insertion loss, coupling and directivity.

4. A miniature directional coupler as claimed in claim 3 wherein said first coupled line and said second coupled line have a length that are equal.

5. A miniature directional coupler as claimed in claim 4 wherein said series resistor means has a resistance value equal to impedance of said second coupled line.

6. A miniature directional coupler as claimed in claim 5 wherein said series inductor means has an inductance value dependent on coupling flatness, center frequency and coupling value.

7. A miniature directional coupler as claimed in claim 6 wherein said parallel resistor means has a resistance value dependent on impedance of said second coupled line and said value of said series inductor means.

8. A miniature directional coupler as claimed in claim 7 wherein tuning of the center frequency and coupling is realized by varying the value of said series inductor means.

9. A miniature directional coupler as claimed in claim 1 wherein said first coupled line length and said second coupled line length is equal to approximately $\Lambda_o/20$ where $\Lambda_o$ is the center wavelength in said coupled lines and said parallel resistor means comprises a resistor equal to the impedance of said second coupled line.

10. A miniature directional coupler comprising:

a first minimum coupling flatness coupler comprised of a first coupled line having an input and an output and a second coupled line separated by a gap, said second coupled line having an input and an output;

a second high directivity directional coupler comprised of said second coupled line and a third coupled line separated by a gap, said third coupled line having an input and an output;

first resistor means connected between said input of said first coupled line and ground;

second resistor means connected between said input of said third coupled line and ground;

inductor means connected between said output of said third coupled line and an output of said miniature directional coupler; and, third resistor means connected between said inductor means and ground.

11. A miniature directional coupler as claimed in claim 10 wherein said first coupled line and said third coupled line have a length of less than $\Lambda_o/4$ where $\Lambda_o$ is center wavelength in coupled lines.

12. A miniature directional coupler as claimed in claim 11 wherein said first coupled line and said third coupled line have a length dependent on center frequency, insertion loss, coupling and directivity.

13. A miniature directional coupler as claimed in claim 1 2 wherein said first coupled line and said third coupled line have a length that are equal.

14. A miniature directional coupler as claimed in claim 13 wherein said second resistor means has a resistance value equal to impedance of said third coupled line.

15. A miniature directional coupler as claimed in claim 14 wherein said inductor means has an inductance value dependent on coupling flatness, center frequency and coupling value.

16. A miniature directional coupler as claimed in claim 15 wherein said third resistor means has a resistance value dependent on the impedance of said third coupled line and said value of said inductor means.

17. A miniature directional coupler as claimed in claim 16 wherein tuning of the center frequency and coupling is realized by varying the value of said inductor means.

* * * * *